United States Patent [19]

Teach

[11] 4,081,919

[45] Apr. 4, 1978

[54] BACKHOE BUCKET

[75] Inventor: Ted L. Teach, Dayton, Ohio

[73] Assignee: Laserplane Corporation, Dayton, Ohio

[21] Appl. No.: 782,926

[22] Filed: Mar. 30, 1977

[51] Int. Cl.[2] ..... E02F 5/02

[52] U.S. Cl. ..... 37/103; 37/117.5; 37/141 R; 214/146 R

[58] Field of Search ..... 37/141 R, 141 T, 103, 37/118, 117.5; 214/131 R, 145 R, 145 A, 146

[56] References Cited

U.S. PATENT DOCUMENTS

| | | | |
|---|---|---|---|
| 2,764,306 | 9/1956 | Dorkins | 37/117.5 |
| 3,070,246 | 12/1962 | Johnson et al. | 37/117.5 X |
| 3,419,170 | 12/1968 | Salna et al. | 37/117.5 X |
| 3,854,608 | 12/1974 | Arnold | 37/117.5 X |
| 3,860,131 | 1/1975 | Borowski et al. | 37/118 R |
| 3,975,844 | 8/1976 | Olson | 37/141 R X |

FOREIGN PATENT DOCUMENTS

| | | | |
|---|---|---|---|
| 679,830 | 9/1952 | United Kingdom | 214/146 |
| 1,210,129 | 10/1970 | United Kingdom | 37/117.5 |
| 1,441,233 | 2/1974 | United Kingdom | 37/117.5 |

*Primary Examiner*—E. H. Eickholt
*Attorney, Agent, or Firm*—W. A. Schaich

[57] ABSTRACT

The invention relates to a digging bucket for a backhoe or similar excavating machine, wherein the effective forward digging edge of the bucket may selectively comprise a transverse row of digging teeth for use in the primary phases of an excavation or a blade-type edge used for smoothing the bottom of the excavation. The backhoe bucket structure permitting this instantaneous choice by the operator comprises a conventional bucket having digging teeth secured thereto to the forward edge of the bottom but the medial portion of the bottom of the bucket is movably mounted relative to the remainder of the bucket so that the forward edge of the movable bottom portion can be dropped to a position below the digging teeth to function as a smoothing blade.

2 Claims, 2 Drawing Figures

BACKHOE BUCKET

BACKGROUND OF THE INVENTION

A backhoe is probably the most widely used implement at the current time for excavating basements, foundations, or trenches. As is well known, the digging efficiency of such backhoe, particularly in tight or stony soils, is greatly improved by utilizing a row of relatively sharp digging teeth spaced across the forward edge of the backhoe bucket. While such digging teeth are effective in the initial phases of the digging operation, they cannot be utilized when it is desired to produce a smooth planar surface on the bottom of the excavation.

With prior backhoe constructions, it was necessary to remove the digging teeth and substitute a digging blade for such teeth, which is a time-consuming and hence, expensive operation.

OBJECTS OF THE INVENTION

It is accordingly an object of this invention to provide a digging bucket for a backhoe or similar excavating machine wherein the digging edge of the bucket may, at the desire of the operator, be immediately converted from a row of transversely spaced digging teeth to a blade or edge configuration.

A particular object of this invention is to provide an improved backhoe bucket of conventional configuration with a plurality of digging teeth rigidly secured to the foreward edge of such bucket, but with a medial portion of the bottom of the bucket movably mounted relative to the remainder of the bucket so that the leading edge of said movable bottom portion may be dropped to a position below the digging teeth and, in such lowered position, be utilized to effect a smoothing or grading operation on the bottom of the excavation.

Further objects and advantages of this invention will become apparent to those skilled in the art from the following detailed description thereof, taken in conjunction with the annexed sheet of drawings.

Figure 1:
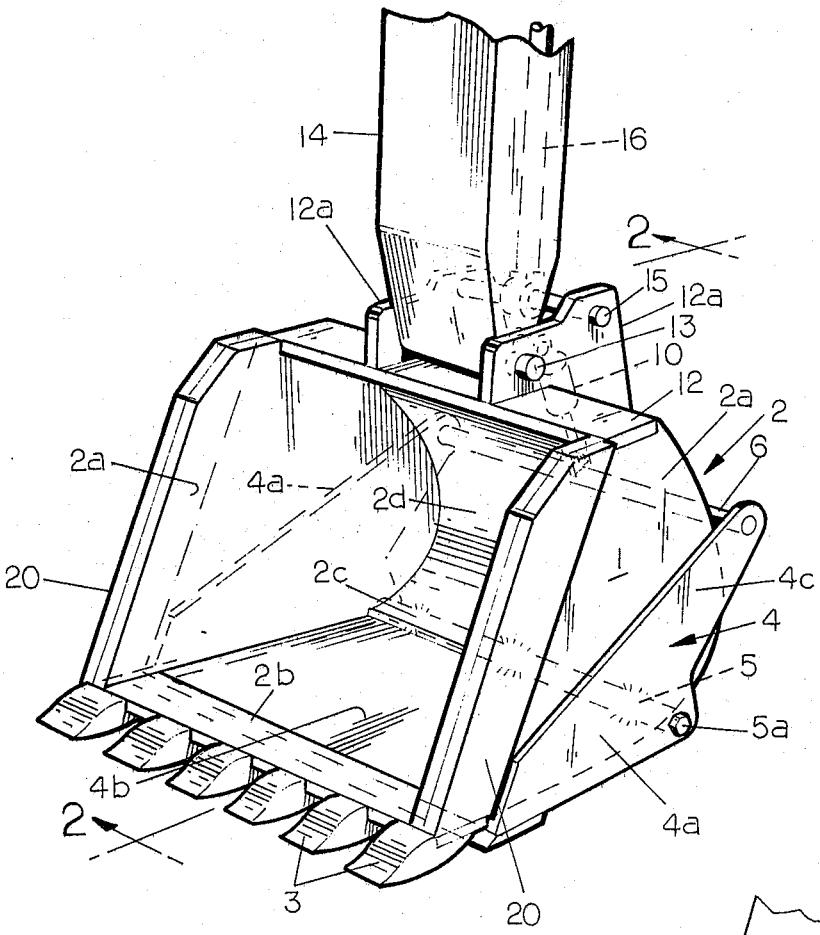
FIG. 1 is a perspective view of a backhoe bucket embodying this invention.

Referring to the drawings, numeral 1 indicates a digging bucket embodying this invention. Bucket 1 comprises a primary frame 2 of conventional configuration, comprising planar side walls 2*a*, a forward bottom wall 2*b*, and a rearwardly spaced bottom wall section 2*c*, which curves upwardly and forwardly to define a rear wall 2*d* of the bucket. All of these members are made of heavy metal sheets and are welded together in conventional fashion. The result is a bucket having an open bottom portion between the front bottom portion 2*b* and the rear bottom portion 2*c*. A plurality of sharpened digging teeth 3 are respectively secured to the under side of the forward bottom portion 2*b* of the primary frame 2 by suitable bolts (not shown). A top plate 12 is welded across the top extremities of the side walls 2*a* of the primary frame and also to the top portion of the rear wall 2*d*. In the center of the top plate 10 and rear wall 2*d*, a pair of spaced upstanding brackets 12*a* are respectively welded which provide mountings for a pivot pin 13 which secures the bucket to a boom 14 of a backhoe or similar excavating machine. A pin 15 traversing brackets 12*a* provides a pivotal mounting of the bucket to the actuating rod 16 of a hydraulic cylinder (not shown) which controls the pivotal position of the digging bucket with respect to the supporting boom. The open space in the bottom of primary frame 2 is occupied by a movable bottom member 4, which is of generally "U"-shaped configuration, having upstanding planar sidewalls 4*a* and a bottom wall portion 4*b* designed to fit snugly within the open bottom space provided in the primary frame structure 2.

The movable bottom member 4 is pivotally connected to the primary frame 2 by a pair of pivot bolts 5*a* which traverse appropriate apertures in the bottom rear corner of the side walls 4*a* and threadably engage threaded holes in the ends of a rod 5 welded to the bottom rear corner of the side walls 2*a* and rear wall 2*d* of the primary frame. Additionally, the side walls 4*a* of the movable bottom member 4 respectively have upwardly and rearwardly integral projections 4*c* which extend beyond the curved rear surface 2*d* of the primary frame and are rigidly secured together by a transverse rod 6. A pair of pivot pin brackets 8 (FIG. 2) are provided on the top of the rear wall 2*d* of the primary frame and a double-acting hydraulic cylinder 10 has its opposed ends respectively pivotally mounted to a pin 8*a* traversing brackets 8 and a pivot plate 6*a* secured to the transverse rod 6. Thus the movable bottom element 4 may be shifted from the closed position shown in FIG. 1 to an open position shown in dotted lines in FIG. 2, wherein the forward edge of the movable bottom 4*b* is displaced downwardly with respect to the forward bottom portion 2*b* of the primary bucket frame and below teeth 3.

In normal digging operations, the cylinder 10 is actuated to hold the movable bottom 4 in its closed position, wherein the bucket 1 resembles a conventional bucket and the forwardly projecting digging teeth 3 are the primary elements utilized to engage the soil to be excavated. When, however, the desired excavation depth has been reached, and it is desired to smooth the bottom of the excavation, the digging teeth 3 are, of course, incapable of leaving a smooth surface along the bottom of the excavation. Previously it has been required to remove the digging teeth from the digging bucket and substitute a linear, or bladelike, digging edge for the digging teeth or substitute another bucket. This substitution, involving the loosening of relatively massive bolts or pins, which are always rusted and dirt-encrusted, involves a substantial amount of time.

Figure 2:
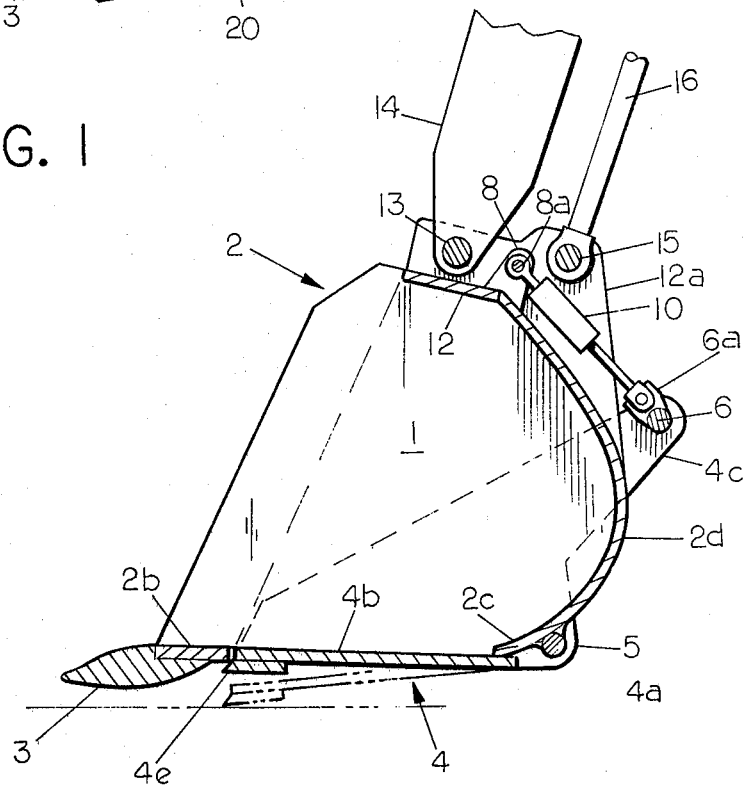
FIG. 2 is a vertical sectional view taken on the plane 2—2 of FIG. 1.

In accordance with this invention, when the excavation has reached its desired depth, the operator merely directs hydraulic fluid to the cylinder 10 and moves the movable bottom portion 4*b* of the bucket 1 to the open, or down, position shown in dotted lines in FIG. 2. In this position, the forward edge of the movable bottom portion acts as the primary contact with the dirt at the bottom of the excavation and produces a smooth surface.

If desired, a bladelike digging edge 4*e* may be permanently secured, as by welding, to the underside of the forward edge of the movable bottom 4*b*. This digging edge may be of hardened steel and provides greater wear resistance at less cost than would be required to effect the hardening of the forward edge of the movable bottom portion 4. It does not disturb the smooth bottom contour of the digging bucket when the movable bottom is closed, since it is disposed on the bottom side of the movable bottom portion 4*b*.

Also, it is desirable to provide protection for the side walls 4a of the movable bottom portion 4 against primary impact with the dirt being excavated, and this may be provided by the utilization of two bars 20 respectively secured to the outer walls of the forward portions of the side walls 2a of the primary bucket frame. The thickness of the bars 20 is somewhat in excess of that of the side walls 4a and hence effectively shields such side wall members from primary impact with the soil being excavated.

Various modifications of the above-described structure will be apparent to those skilled in the art, and it is intended that all such modifications be included within the scope of the appended claims.

I claim:

1. A digging bucket for a backhoe or similar machine for producing a smooth-bottomed excavation, comprising, in combination:

(1) a "U"-shaped primary frame having planar sidewalls rigidly interconnected by two spaced, fixed bottom portions;

(2) the first of said fixed bottom portions comprising a transverse bar extending across the forward portions of the bucket and rigidly mounting a plurality of forwardly projecting, laterally spaced digging teeth;

(3) the other of said fixed bottom portions comprising an upwardly curved sheet, rearwardly spaced from said transverse bar and extending upwardly to define at least a portion of the back wall of the digging bucket;

(4) a movable bottom member of generally "U"-shaped configuration, constructed and arranged to snugly surround said primary frame and having a platelike bottom portion thereof fitting snugly within the space provided between said fixed bottom portions;

(5) means for pivotally securing the side walls of said movable bottom member respectively to opposite sides of said other bottom portion of said primary frame;

(6) a pair of reinforcing bars respectively secured to the outer forward portions of said planar side walls of said primary frame, said reinforcing bars being of a greater thickness than said side walls of said movable bottom member, thereby protecting said side walls of said movable bottom member from primary engagement with any soil being dug, and (7) power means for pivoting said movable bottom member relative to said primary frame to displace the forward edge of said platelike bottom portion a limited distance downwardly relative to said digging teeth, whereby said forward edge may selectively become the effective digging edge of the bucket to produce a smooth bottomed excavation.

2. A digging bucket in accordance with claim 1, wherein said side walls of said movable bottom member have rearwardly projecting portions extending rearwardly beyond said back wall of the digging bucket, a transverse rod connected between said rearwardly projecting portions, a bracket provided on said rear wall of said primary frame, and said power means comprises an hydraulic cylinder pivotally mounted between said bracket and said transverse rod.

* * * * *